US006743002B1

(12) United States Patent
Millar et al.

(10) Patent No.: US 6,743,002 B1
(45) Date of Patent: Jun. 1, 2004

(54) ROTARY FLUID PRESSURE DEVICE AND IMPROVED INTEGRAL BRAKE ASSEMBLY

(75) Inventors: Jarett D. Millar, Minneapolis, MN (US); James M. LeClair, Jr., Shakopee, MN (US); Wayne B. Wenker, Eden Prairie, MN (US); Bernie W. Neuhaus, Glencoe, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/357,089

(22) Filed: Feb. 3, 2003

(51) Int. Cl.[7] ..... F03C 2/00

(52) U.S. Cl. ..... 418/61.3; 418/181; 188/170; 188/71.1

(58) Field of Search ..... 418/61.3, 181; 188/71.1, 170

(56) References Cited

U.S. PATENT DOCUMENTS

| | | | | |
|---|---|---|---|---|
| 3,680,666 A | | 8/1972 | Sommer | |
| 4,014,414 A | | 3/1977 | Yamamoto et al. | |
| 4,184,573 A | | 1/1980 | Bricker et al. | |
| 4,470,487 A | | 9/1984 | Blatt | |
| 5,992,578 A | * | 11/1999 | Lallier | 188/72.3 |
| 6,132,194 A | | 10/2000 | Wenker et al. | |
| 6,321,882 B1 | * | 11/2001 | Heckel et al. | 418/61.3 |
| 6,585,088 B1 | * | 7/2003 | Fontaine et al. | 188/170 |

FOREIGN PATENT DOCUMENTS

| | | | | |
|---|---|---|---|---|
| DE | 3125087 A | * | 1/1983 | F03C/2/08 |
| JP | 58085370 A | * | 5/1983 | F03C/2/08 |

* cited by examiner

*Primary Examiner*—Theresa Trieu
(74) *Attorney, Agent, or Firm*—L. J. Kasper

(57) ABSTRACT

A gerotor motor including a brake package, and a method for setting the load holding torque of the brake package. The endcap assembly (21) defines a set of internal threads (85) disposed adjacent a brake package piston member (75). An enclosure member (87) defines a spring seat (115) for a set of Belleville washers (105), and defines a set of external threads (88) engaging the internal threads (85). Upon assembly of the motor and brake package, a resistance load is applied to a motor output shaft (43) corresponding to a desired load holding torque. The motor is pressurized sufficiently to rotate the output shaft in opposition to the resistance load. The enclosure member (87) is rotated so that it moves axially in a direction to increase the bias preload on the Belleville washers (105) until the output shaft (43) no longer rotates.

7 Claims, 2 Drawing Sheets

PRIOR ART Fig. 1

ROTARY FLUID PRESSURE DEVICE AND IMPROVED INTEGRAL BRAKE ASSEMBLY

BACKGROUND OF THE DISCLOSURE

The present invention relates to rotary fluid pressure devices, and more particularly, to such devices of the type including an integral brake assembly, suitable for braking motion either into, or out of, a rotary fluid displacement mechanism. The present invention also relates to an improved method of setting the load holding torque capability of a brake assembly associated with a hydraulic motor.

Although the present invention may be utilized in rotary fluid pressure devices in which the rotary fluid displacement mechanism comprises any one of a number of different types of mechanisms, it is especially advantageous when utilized in a device in which the displacement mechanism comprises a gerotor gear set, and will be described in connection therewith. As used herein and in the appended claims, the term "gerotor" will be understood to mean and include both a conventional gerotor device, in which the ring member includes integrally-formed internal teeth, and roller gerotors, in which the internal teeth of the ring member comprise cylindrical roller members.

Furthermore, the present invention is especially suited for use in a gerotor-type device which comprises a low-speed, high-torque ("LSHT") gerotor type hydraulic motor, and will be described in connection therewith.

In many vehicle applications for LSHT gerotor motors, it is desirable for the motor to have some sort of parking brake or parking lock, the term "lock" being preferred in some instances because the vehicle manufacturer intends that the parking lock be engaged only after the vehicle is stopped. In other words, such parking lock devices are not intended to be dynamic brakes, which would be engaged while the vehicle is moving, to bring the vehicle to a stop. However, the term "brake" will generally be used hereinafter to mean and include both brakes and locks, the term "brake" being somewhat preferred to distinguish the device of the present invention from a device which would operate in only a fully engaged or fully disengaged condition.

Recently, the assignee of the present invention has developed, and has begun to commercialize a gerotor motor including an integral brake package which, for many vehicle applications, is quite satisfactory in performance, is fairly simple and inexpensive, and is quite compact. The gerotor motor and brake package referenced above is illustrated and described in U.S. Pat. No. 6,132,194, assigned to the assignee of the present invention and incorporated herein by reference.

Typically, brake packages which are used with hydraulic motors, and especially those brake packages used as integral brake packages with LSHT gerotor motors, are of the "spring-applied, pressure-released" type as is now well known to those skilled in the art. In other words, the braking members (e.g., friction discs, etc.) are biased toward braking engagement by some sort of spring arrangement, and are move toward a brake-disengaged condition by hydraulic pressure. As is now well known to those skilled in the art, the hydraulic pressure to disengage the brake may be internal case pressure, or an external "pilot" pressure from a system charge pump, or any other suitable source of pressure, the details of which are not essential features of the present invention.

As is also well known to those skilled in the art, one of the primary performance criteria of a brake package of the type to which the present invention relates is the "load holding capacity" of the brake assembly. In a typical spring-applied, pressure-released brake assembly, the load holding capacity (or load holding torque) is a direct function of the springs which bias the brake assembly into braking engagement.

Therefore, although the brake assembly of the above-incorporated patent operates in a very satisfactory manner, the increasing commercial popularity has uncovered one shortcoming of the design. As the motor and brake assembly are used on a greater range of vehicle applications, the assignee of the present invention has been requested to provide motor and brake assemblies having a wide range of load holding torques. Unfortunately, providing one basic motor and brake assembly which has a different load holding torque for each of several different customers and vehicle applications requires the motor manufacturer to, for example, provide a different endcap (having a different length of brake chamber) for each load holding torque desired. However, as is well known to those skilled in the art, a proliferation of part numbers for the same basic motor component adds substantially to the overall cost of manufacture of the motors.

Alternatively, for each desired load holding torque, a different sized spring shim member can be utilized (i.e., having a different axial length) to provide a different spring preload on the axially moveable member of the braking package. However, the need to specify and stock a different shim for every possible load holding torque which may be desired also adds substantially to the overall complexity of the assembly process and the cost of manufacture of the motor.

BRIEF SUMMARY OF THE INVENTION

Accordingly, it is an object of the present invention to provide an improved rotary fluid pressure device and brake assembly which overcomes the above-described disadvantages of the prior art brake assembly.

It is a more specific object of the present invention to provide a gerotor motor and brake assembly for use therein which can be integral with the motor, but can provide any desired one of a wide range of load holding capacities, without the need for selection among a large number of various sizes of a common component.

It is a further object of the present invention to provide a gerotor motor and brake assembly which accomplishes the above-stated objects, and which increases the likelihood that each motor, when it is made and assembled, will provide the load holding capability desired by the customer for that particular motor, without any further changes or adjustments, either in the motor assembly plant, or at the customer's vehicle assembly plant.

It is a related object of the present invention to provide an improved method for setting the load holding torque capability of a brake assembly of a hydraulic motor, wherein the improved method does not require the use of components which are peculiar to each of the possible, desired load holding torques.

The above and other objects of the invention are accomplished by the provision of a rotary fluid pressure device of the type including a housing defining a fluid inlet and a fluid outlet. A rotary fluid displacement mechanism includes an output member having either orbital or rotational movement, the mechanism including a brake portion extending axially rearward from the output member, and operably associated with the output member such that braking movement of the brake portion results in braking of the output member. The housing defines a generally cylindrical brake chamber and a piston member is disposed in the brake chamber, the piston member being moveable between a first, retracted position under the influence of fluid pressure in the brake chamber and a second, engaged position under the influence of a biasing spring disposed in engagement with a rearward side of the piston member.

The improved rotary fluid pressure device is characterized by the housing defining a set of internal threads disposed adjacent the piston member. An enclosure member has a forward surface comprising a spring seat for the biasing spring. The enclosure member defines a set of external threads in threaded engagement with the set of internal threads, whereby the axial location of the enclosure member and the spring seat is adjustable in response to rotation of the enclosure member, to vary the load holding torque of the brake portion.

In accordance with a more limited aspect of the invention, the improved rotary fluid pressure device is characterized by the biasing spring exerting an axial force in a rearward direction on the enclosure member, the axial force comprising substantially the only means for retaining the enclosure member within the set of internal threads defined by the housing.

In accordance with another aspect of the present invention, there is provided an improved method for setting the load holding torque of a brake package operably associated with a hydraulic motor. The motor is of the type comprising a housing defining a fluid inlet and a rotary fluid displacement mechanism including an output member and an output shaft and means for transmitting torque from the output member to the output shaft. The brake package is of the spring-applied type and includes a brake portion operably associated with the output member, and a piston member moveable between a first retracted position, and a second, engaged position under the influence of a biasing spring. A member is disposed adjacent the piston member and has a forward surface comprising a spring seat for the biasing spring.

The improved method is characterized by:

(a) applying to the output shaft a resistance load corresponding to a desired load holding torque, the resistance load causing rotation of the output shaft when the piston member is in the first, retracted position; and (b) moving the member axially in a direction tending to increase the bias preload on the biasing spring until the output shaft no longer rotates.

DETAILED DESCRIPTION OF THE PREFERRED EMBODIMENT

Figure 1:
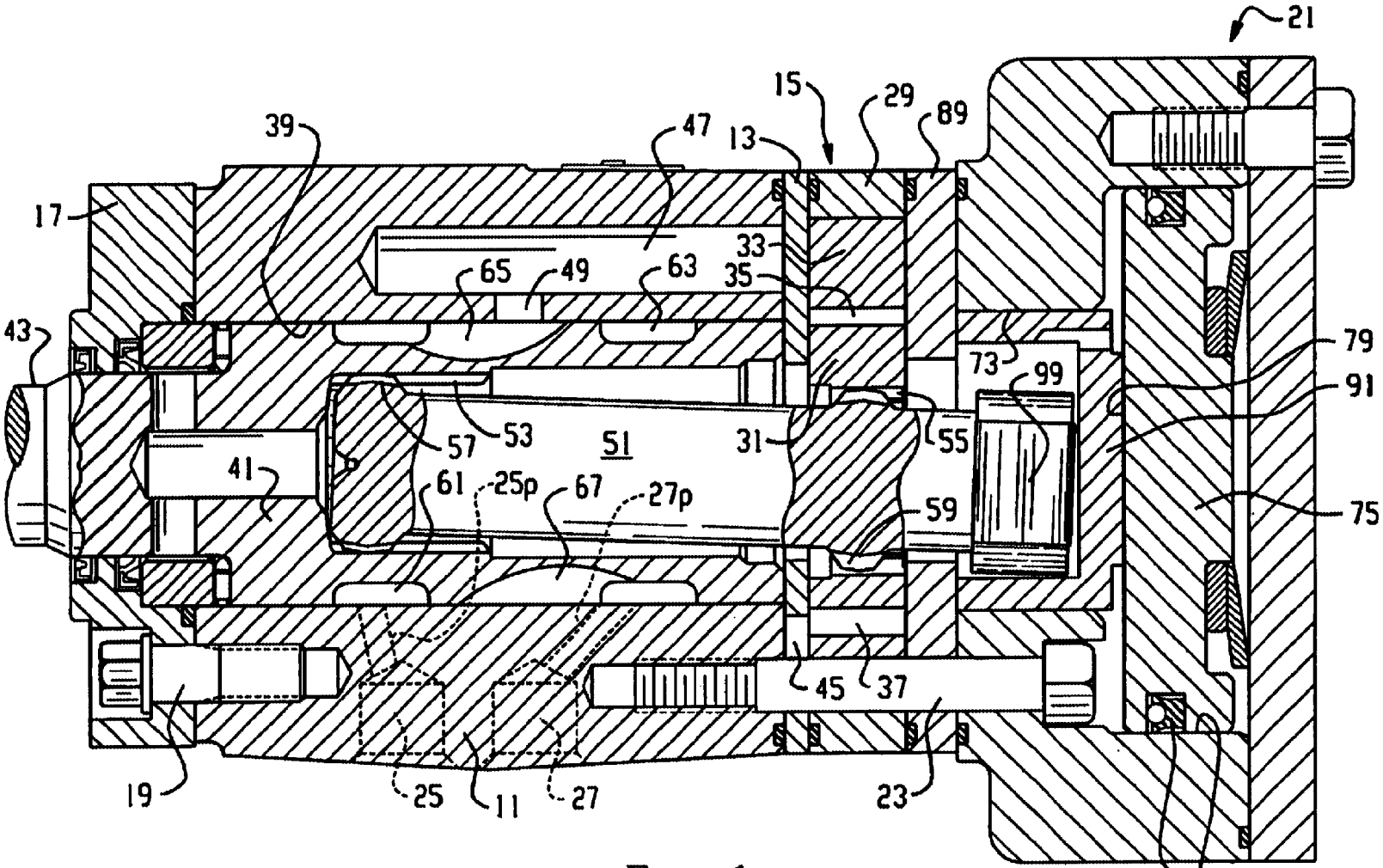
FIG. 1 is an axial cross-section of a gerotor motor including a parking brake of the general type to which the present invention relates, but which comprises "Prior Art", relative to the present invention.

Referring now to the drawings, which are not intended to limit the invention, FIG. 1 is an axial cross-section of a low-speed, high-torque ("LSHT") gerotor motor of the type which may include a brake assembly of the type to which the present invention relates. More specifically, FIG. 1 shows a gerotor motor including the brake assembly of the type illustrated and described in the above-incorporated U.S. Pat. No. 6,132,194.

The gerotor motor of FIG. 1 comprises a valve housing section 11, a port plate 13, and a fluid energy-translating displacement mechanism, generally designated 15, which, in the subject embodiment, is a roller gerotor gear set. The motor includes a forward endcap 17, held in tight sealing engagement with the valve housing section 11 by means of a plurality of bolts 19, and a rearward endcap assembly 21, held in tight sealing engagement with the valve housing section 11 by means of a plurality of bolts 23. The valve housing section 11 includes a fluid inlet port 25, and a fluid outlet port 27, shown only in dashed lines in FIG. 1. It is understood by those skilled in the art that the ports 25 and 27 may be reversed, thus reversing the direction of operation of the motor.

Referring still to FIG. 1, the gerotor gear set 15 includes an internally-toothed ring member 29, through which the bolts 23 pass (only one of the bolts 23 being shown in FIG. 1), and an externally-toothed star member 31. The internal teeth of the ring member 29 comprise a plurality of cylindrical rollers (or "teeth") 33, as is now well known in the art. The teeth 33 of the ring 29 and the external teeth of the star 31 inter-engage to define a plurality of expanding volume chambers 35, and a plurality of contracting volume chambers 37, as is also well known in the art.

The valve housing section 11 defines a spool bore 39, and rotatably disposed therein is a spool valve 41. Formed integrally with the spool valve 41 is an output shaft 43, shown only fragmentarily in FIG. 1. In fluid communication with each of the volume chambers 35 and 37 is an opening 45 defined by the port plate 13, and in fluid communication with each of the openings 45 is an axial passage 47 formed in the valve housing section 11. Each of the axial passages 47 communicates with the spool bore 39 through an opening 49. The housing section 11 also defines fluid passages 25*p* and 27*p*, providing fluid communication between the spool bore 39 and the inlet port 25 and outlet port 27, respectively.

Disposed within the hollow, cylindrical spool valve 41 is a main drive shaft 51, commonly referred to as a "dog bone" shaft. The spool valve 41 defines a set of straight, internal splines 53, and the star 31 defines a set of straight, internal splines 55. The drive shaft 51 includes a set of external, crowned splines 57 in engagement with the internal splines 53, and a set of external, crowned splines 59 in engagement with the internal splines 55. Thus, the orbital and rotational movements of the star member 31 are transmitted, by means of the dog bone shaft 51, into purely rotational movement of the output shaft 43, as is well known in the art.

The spool valve 41 defines an annular groove 61 in continuous fluid communication with the inlet port 25, through the passage 25*p*. Similarly, the spool valve 41 defines an annular groove 63, which is in continuous fluid communication with the outlet port 27, through the passage 27*p*. The spool valve 41 further defines a plurality of axial slots 65 in communication with the annular groove 61, and a plurality of axial slots 67 in communication with the annular groove 63. The axial slots 65 and 67 are also frequently referred to as feed slots or timing slots. As is generally well known to those skilled in the art, the axial slots 65 provide fluid communication between the annular groove 61 and the openings 49, disposed on one side of the line of eccentricity of the gerotor set 15, while the axial slots 67 provide fluid communication between the annular groove 63 and the openings 49, which are on the other side of the line of eccentricity. The resulting "commutating valving"

action between the axial slots 65 and 67 and the openings 49, as the spool valve 41 rotates, is well known in the art and will not be described further herein.

Those portions of the motor described up to this point are generally conventional and well known to those skilled in the art. Referring still primarily to FIG. 1, but now also to FIG. 2, the parking brake assembly of the present invention will now be described. The rearward endcap assembly 21 defines a relatively larger, internal chamber 71, and a relatively smaller, forward internal chamber 73. In the subject embodiment, both of the chambers 71 and 73 are generally cylindrical, although it should be understood that such is not an essential feature of the invention with regard to the chamber 71. However, as a practical matter, the chamber 73 must be cylindrical (for purposes of the subject embodiment, but not for purposes of the present invention in its broader aspects). Disposed within the chamber 71 is a generally cylindrical lock piston 75, which includes an o-ring seal 77 disposed about its outer periphery and in sealing engagement with the internal surface of the chamber 71. The lock piston 75 includes a forward, generally annular engagement surface 79, the function of which will be described in greater detail subsequently.

Disposed rearwardly of the piston 75, the endcap assembly 21 defines a rearward-most annular chamber 81 which, in subject embodiment, actually comprises two different chamber portions: a relatively larger, cylindrical portion against which is seated an o-ring seal 83, and just forwardly of the o-ring seal 83, an internally threaded portion 85. For reasons of assembly and installation of the lock piston 75, the diameter of the internally threaded portion 85 needs to be somewhat greater than the diameter of the brake chamber 71. Disposed within the annular chamber 81 is an enclosure member, generally designated 87, which defines an annular groove receiving the o-ring seal 83, and which will be described further hereinafter. The enclosure member 87 defines a set of external threads 88, in mating, threaded engagement with the internally threaded portion 85. Thus, and as will be described further hereinafter, rotation of the enclosure member 87 results in axial movement thereof, relative to the endcap assembly 21.

Figure 2:
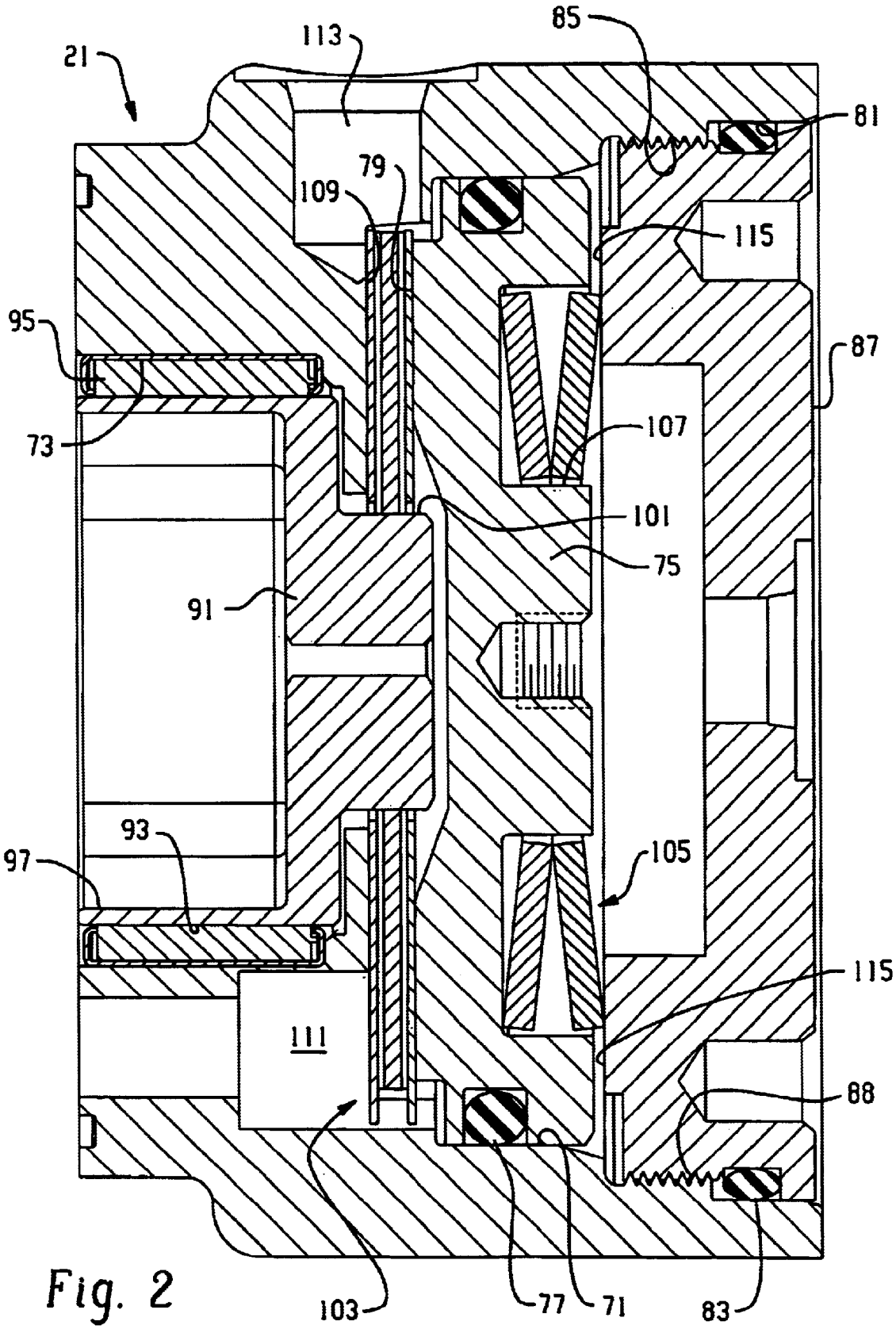
FIG. 2 is an enlarged, fragmentary, axial cross-section of a brake assembly made in accordance with the present invention.

Referring again to FIG. 1, in conjunction with FIG. 2, it should be noted that there is a wear plate 89 disposed axially between the gerotor set 15 and the rearward endcap assembly 21. In some applications, the wear plate 89 may not be considered essential for the proper performance of the motor, and therefore, may be omitted, such that the endcap assembly 21 would be immediately adjacent the gerotor gear set 15. As a result, references hereinafter and in the appended claims, to frictional engagement with the fluid displacement mechanism (i.e., the gerotor gear set 15), will be understood to mean and include either direct frictional engagement with one of the members of the gerotor gear set itself, such as the star 31, or only indirect frictional engagement with the gerotor gear set, by means of direct frictional engagement with the adjacent wear plate 89.

In the subject embodiment, and by way of example only, disposed within the chamber 73 is a generally cylindrical brake member 91, including a cylindrical outer surface 93 (see FIG. 2) in closely spaced apart, sliding engagement with either the cylindrical internal surface of the chamber 73, or as is shown in the subject embodiment, with a needle bearing set 95 (or some other suitable form of bearing or journal arrangement, none of which is essential to the present invention).

Referring still to both FIGS. 1 and 2, the brake member 91 defines an internal chamber 97, and disposed within the chamber 97 is a spinner member 99 (shown only in FIG. 1) which is able to move slightly within the internal chamber 97, in response to the orbital and rotational movement of the main drive shaft 51, as is now well known to those skilled in the art and is illustrated and described in greater detail in the above-incorporated patent.

Referring again primarily to FIG. 2, the brake member 91 defines a rearward, generally annular portion 101, and in splined engagement therewith is a brake pad assembly, generally designated 103, the details of which are not essential features of the present invention. It will be understood by those skilled in the art that the brake pad assembly 103 would typically include at least one member fixed to be non-rotatable relative to the endcap assembly 21, and at least one member fixed to be non-rotatable relative to the annular portion 101 of the brake member 91. Therefore, axial loading of the brake pad assembly 103 by the annular engagement surface 79 of the lock piston 75 is responsible for the overall load holding capacity of the brake assembly. This axial loading is accomplished by means of the lock piston 75 being biased to the left in FIG. 2 toward the engaged position, under the influence of a set of Belleville washers 105. In the subject embodiment, and by way of example only, the Belleville washers 105 are disposed within an annular chamber 107 defined by the lock piston 75.

In the subject embodiment, and by way of example only, the endcap assembly 21 defines a transverse, annular surface 109, and it is against this surface 109 that the brake pad assembly 103 is biased by the annular engagement surface 79 of the lock piston 75, under the influence of the Belleville washers 105. What has been described up to this point comprises the basic "spring-applied" aspect of the brake package. The end cap assembly 21 defines an annular pressure chamber 111, into which pressurized fluid may be introduced, such as by means of a fluid port 113, which may be connected with an external source of charge pressure or pilot pressure, as was referenced previously. Whenever it is desired to have the brake package disengaged, to permit normal operation of the motor, pressurized fluid is communicated into the port 113, then into the chamber 111, the pressure then biasing the lock piston 75 to the right in FIG. 2, toward its retracted (disengaged) position. In the disengaged position, the brake pad assembly 103 is disengaged, such that the brake member 91 is free to rotate, without exerting any substantial braking effort (torque) on the "brake portion", which in the subject embodiment, comprises the spinner member 99, the rearward end portion of the main drive shaft 51, and the brake member 91.

The enclosure member 87 includes a forward surface 115 which also serves as a spring seat for the Belleville washers 105, such that the references hereinafter to the "spring seat" will also bear the reference numeral "115". As will be understood by those skilled in the art of brake packages, the load holding capacity (or torque) of the brake package of the present invention is a function of the initial load applied by the Belleville washers 105 on the lock piston 75, which, in turn, determines the engagement force applied by the lock piston 75 on the brake pad assembly 103. As may best be seen in FIG. 2, there is an axial space between the rearward surface of the lock piston 75 and the spring seat 115, defined by the enclosure member 87. The presence of the axial space permits axial movement (adjustment) of the enclosure member 87 to vary the bias preload on the lock piston 75, exerted by the Belleville washers 105.

Such adjustment of the bias preload can be achieved, in accordance with the present invention, because of the enclosure member 87 having threaded engagement with the end cap assembly 21, by means of the internally threaded portion 85 defined by the endcap assembly 21, and the mating external threads 88 defined by the enclosure member 87. Therefore, upon assembly of the brake package of the present invention to the general condition of assembly, as represented in FIG. 2, and with no pressurized fluid being communicated to the fluid port 113, the brake package may be adjusted, as will now be described, i,e., the load holding torque capacity of the brake package may be set or adjusted.

Typically, in order to "set" (establish) or adjust the load holding torque capacity or capability of the brake package, a torque resistance or "load" equal to the desired load holding torque is applied to the motor output shaft 43. This may be done in any of several ways, one of which is to utilize another hydraulic motor (not the one being assembled), and communicating to its inlet port sufficient fluid pressure to generate an "output torque" to the output shaft 43 of the motor being assemble which is equal to the desired load holding torque. Alternatively, a separate resistance load is applied to the output shaft 43, and pressurized fluid is communicated to the inlet port 25 (of the motor being assembled) at a flow rate just sufficient to turn (or drive) the output shaft 43 of the motor at a very slow speed (e.g., at about one revolution per minute). Assuming, by way of example only, that upon initial assembly the enclosure member 87 was not threaded inward (to the left in FIG. 2) sufficiently to achieve the desired load holding torque, communicating pressurized fluid to the load motor would cause it to rotate the output shaft 43 of the motor being assembled rather easily, or, in the alternative approach, communicating pressurized fluid to the motor being assembled would cause the output shaft 43 to turn rather easily.

In either approach to applying a load to the motor being assembled, next, the assembly operator would rotate the enclosure member 87, causing it to move further, axially, into the end cap assembly 21. As the enclosure member 87 (and the spring seat 115) moves further to the left in FIG. 2, the bias preload on the Belleville washers 105 increases, thus increasing the torque applied to the "brake portion" and thus the load holding torque gradually increases. The assembly operator would continue to rotate the enclosure member 87 until it reaches a point at which the output shaft 43 no longer rotates, thus indicating that the brake package is now able to "hold" the desired torque load, as is being applied to the output shaft 43 by either the pressurized load motor, or the separate load being driven by pressurization of the motor being assembled.

In accordance with an important aspect of the present invention, one of the significant benefits of using the threaded enclosure member 87 to vary the preload on the Belleville washers 105 is that, once the correct position of the enclosure member 87 has been achieved, no further action (or structure, or expense) is required in order to maintain the enclosure member 87 in its "desired" position (i.e., the position which achieves the desired load holding torque). Once the enclosure member 87 is in the desired position, the axial force which the Belleville washers 105 exert on the spring seat 115 would typically be on the order of about 700 to about 1700 pounds-force (3113 to 7562 Newtons). Thereafter, there is always at least the amount of axial force previously noted, acting to hold the enclosure member 87 in place, and to resist any rotational movement thereof which would have the effect of changing the bias preload setting exerted on the brake pad assembly 103.

Although the present invention has been described in connection with an embodiment in which the member 87 is described as an "enclosure" member, i.e., it somewhat serves as the rearward endcap, those skilled in the art will understand that the invention is not so limited. All that is essential to the present invention is that there be a readily axially adjustable member which serves as the spring seat 115 for the spring biasing the lock piston 75, and for simplicity and ease of manufacture, what is preferred is a member having external threads which can be inserted into a mating set of internal threads defined by the endcap.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including a housing defining a fluid inlet and a fluid outlet; a rotary fluid displacement mechanism including an output member having one of orbital and rotational movement, said mechanism including a brake portion extending axially rearward from said output member; and operably associated with said output member such that braking movement of said brake portion results in braking of said output member; and said housing defining a generally cylindrical brake chamber, and a piston member disposed in said brake chamber, said piston member being moveable between a first, retracted position under the influence of fluid pressure in said brake chamber and a second, engaged position under the influence of a biasing spring disposed in engagement with a rearward side of said piston member; characterized by:

(a) said housing defining a set of internal threads disposed adjacent said piston member;

(b) an enclosure member having a forward surface comprising a spring seat for said biasing spring; and (c) said enclosure member defining a set of external threads in threaded engagement with said set of internal threads, whereby the axial location of said enclosure member and said spring seat is adjustable in response to rotation of said enclosure member to vary the load holding torque of said brake portion.

2. A rotary fluid pressure device as claimed in claim 1, characterized by said rotary fluid displacement mechanism comprises a gerotor gear set including an internally-toothed member and an externally-toothed member eccentrically disposed within said internally-toothed member for relative orbital and rotational movement therein between, said externally-toothed member comprising said output member.

3. A rotary fluid pressure device as claimed in claim 1, characterized by said biasing spring comprises a Belleville washer disposed at least partially within an annular spring chamber defined by one of said piston member and said enclosure member.

4. A rotary fluid pressure device as claimed in claim 1, characterized by said set of internal threads being disposed immediately rearward of said piston member and defining a diameter somewhat greater than the diameter of said brake chamber and said piston member.

5. A rotary fluid pressure device as claimed in claim 1, characterized by said biasing spring exerts an axial force in a rearward direction on said enclosure member, said axial force comprising substantially the only means for retaining said enclosure member within said set of internal threads.

6. A method for setting the load holding torque of a brake package operably associated with a hydraulic motor of the type comprising a housing defining a fluid inlet and a rotary fluid displacement mechanism including an output member and an output shaft and means for transmitting torque from said output member to said output shaft; said brake package being of the spring-applied type and including a brake portion operably associated with said output member, and a piston member moveable between a first, retracted position and a second, engaged position under the influence of a biasing spring, a member disposed adjacent said piston member and having a forward surface comprising a spring seat for said biasing spring, said method being characterized by:

(a) applying to said output shaft a resistance load corresponding to a desired load holding torque, said resistance load causing rotation of said output shaft when said piston member is in said first, retracted position; and (b) moving said member axially in a direction tending to increase the bias preload on said biasing spring until said output shaft no longer rotates.

7. A method for setting the load holding torque of a brake package as claimed in claim 6, characterized by said step (a) comprises communicating pressurized fluid to said fluid inlet sufficient to drive said fluid displacement mechanism and rotate said output shaft in opposition to said resistance load.

* * * * *